US011126106B1

(12) United States Patent
Mizoguchi et al.

(10) Patent No.: US 11,126,106 B1
(45) Date of Patent: Sep. 21, 2021

(54) CHARGING DEVICE AND IMAGE FORMING APPARATUS

(71) Applicant: FUJIFILM Business Innovation Corp., Tokyo (JP)

(72) Inventors: Satoshi Mizoguchi, Kanagawa (JP); Hirofumi Iida, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/115,991

(22) Filed: Dec. 9, 2020

(30) Foreign Application Priority Data

Apr. 28, 2020 (JP) ..... JP2020-079043

(51) Int. Cl.
*G03G 15/02* (2006.01)

(52) U.S. Cl.
CPC ..... *G03G 15/0216* (2013.01); *G03G 15/0233* (2013.01); *G03G 15/0275* (2013.01); *G03G 15/0283* (2013.01); *G03G 2215/022* (2013.01)

(58) Field of Classification Search
CPC ..... G03G 15/02; G03G 15/0208; G03G 15/0216; G03G 15/0233; G03G 15/0266; G03G 15/0275; G03G 2215/02; G03G 2215/021
See application file for complete search history.

(56) References Cited

U.S. PATENT DOCUMENTS 5,459,558 A * 10/1995 Ishiyama ..... G03G 15/0233 361/225
6,847,797 B2 * 1/2005 Nishihama ..... G03G 15/0233 361/221
2008/0131155 A1 * 6/2008 Kobashi ..... G03G 15/0216 399/50
2015/0030356 A1 * 1/2015 Zona ..... G03G 15/0812 399/284

FOREIGN PATENT DOCUMENTS

JP 2005-017383 A 1/2005
JP 2009-132507 A 6/2009

* cited by examiner

*Primary Examiner* — Benjamin R Schmitt
(74) *Attorney, Agent, or Firm* — Sughrue Mion, PLLC

(57) ABSTRACT

A charging device includes a first charging unit that charges a target unit, which is to be charged, by coming into contact with the target unit and a second charging unit that charges the target unit by coming into contact with the target unit and in which distribution of a contact region in contact with the target unit is different from distribution of a contact region in the first charging unit.

12 Claims, 5 Drawing Sheets

FIG. 4A

| | MAIN CHARGING ROLLER | | | | AUXILIARY CHARGING ROLLER | | | |
|---|---|---|---|---|---|---|---|---|
| | NIP LOAD (N) | CROWN AMOUNT (μm) | Δ NIP WIDTH (mm) (END · CENTER) | INITIAL Δ POTENTIAL (END · CENTER (V)) (CALCULATED VALUE ONLY RELATING TO MAIN) | NIP LOAD (N) | CROWN AMOUNT (μm) | Δ NIP WIDTH (mm) (END · CENTER) | INITIAL Δ POTENTIAL (END · CENTER (V)) (CALCULATED VALUE ONLY RELATING TO AUXILIARY) |
| EXAMPLE 1 | 5 | 90 | 0.2 | 5 | 2 | 140 | -0.3 | -10 |
| EXAMPLE 2 | 5 | 110 | 0 | 0 | 2 | 140 | -0.3 | -10 |
| EXAMPLE 3 | 5 | 90 | 0.2 | 5 | 2 | 130 | -0.2 | -5 |
| | | | | | | | | |
| COMPARATIVE EXAMPLE 1 | 5 | 90 | 0.2 | 5 | 5 | 90 | 0.2 | 5 |

FIG. 4B

| | RESULT | | | RELIABILITY EVALUATION RESULT |
|---|---|---|---|---|
| | AMOUNT OF UNEVEN WEAR AFTER ELAPSE OF TIME (μm) | Δ POTENTIAL AFTER ELAPSE OF TIME (END · CENTER (V)) (CALCULATED VALUE ONLY RELATING TO MAIN) | Δ POTENTIAL AFTER ELAPSE OF TIME (END · CENTER (V)) (SUM OF MAIN AND AUXILIARY) (TARGET: ±20 V OR LESS) | OCCURRENCE OF COLOR STREAKING OR DETECTION OF CARRIER |
| EXAMPLE 1 | 2 | 25 | 15 | A |
| EXAMPLE 2 | 1.5 | 15 | 5 | A |
| EXAMPLE 3 | 2 | 25 | 20 | B |
| | | | | |
| COMPARATIVE EXAMPLE 1 | 2.5 | 30 | 35 | C |

CHARGING DEVICE AND IMAGE FORMING APPARATUS

CROSS-REFERENCE TO RELATED APPLICATIONS

This application is based on and claims priority under 35 USC 119 from Japanese Patent Application No. 2020-079043 filed Apr. 28, 2020.

BACKGROUND

(i) Technical Field

The present disclosure relates to a charging device and an image forming apparatus.

(ii) Related Art

In the case of a contact charging device that uses a charging roller, a contact width, which is a so-called nip width, is formed between the charging roller and an image carrier that is a to-be-charged member and that has a photosensitive layer, and non-uniformity in the contact width in a rotation axis direction may sometimes cause uneven wear of the photosensitive layer in the rotation axis direction, that is, end portions of the photosensitive layer may sometimes be worn down more than a central portion of the photosensitive layer does. As the amount of uneven wear increases, the charge voltage at each of the end portions rises, so that there may be a difference in image density between the central portion and each of the end portions, or a carrier that is contained in a developer may flow out to the image carrier, which in turn results in an image defect.

As an example of a charging device used for an application other than image formation, Japanese Unexamined Patent Application Publication No. 2009-132507 discloses a charging device including a charging roller that charges an electrical insulating sheet beforehand so as to prevent the sheet from moving in a serpentine manner or so as to prevent weaving of the sheet and suppresses occurrence of such a serpentine movement or weaving by using an electrostatic force.

Also in the charging device, non-uniformity of a contact width that is defined between the charging roller and a rotating body, which faces the charging roller, may sometimes cause uneven wear of the rotating body in a direction in which a rotation axis of the rotating body extends, that is, end portions of the rotating body may sometimes be worn down more than a central portion of the rotating body does.

In recent years, there has been proposed a charging device that includes two charging rollers so as to perform charging in a short time in order to improve productivity in image formation by increasing process speed (see Japanese Unexamined Patent Application Publication No. 2005-017383).

SUMMARY

Aspects of non-limiting embodiments of the present disclosure relate to providing a charging device having a configuration in which two contact charging units that charge a to-be-charged unit are provided and in which a charge voltage in a rotation axis direction is made more uniform compared with a configuration to which the present disclosure is not applied and an image forming apparatus that employs the charging device.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a charging device including a first charging unit that charges a target unit, which is to be charged, by coming into contact with the target unit and a second charging unit that charges the target unit by coming into contact with the target unit and in which distribution of a contact region in contact with the target unit is different from distribution of a contact region in the first charging unit.

BRIEF DESCRIPTION OF THE DRAWINGS

An exemplary embodiment of the present disclosure will be described in detail based on the following figures, wherein:

FIGS. 4A and 4B are diagrams illustrating parameters of a main charging roller and an auxiliary charging roller and results after elapse of time.

DETAILED DESCRIPTION

An exemplary embodiment of the present disclosure will be described below. The exemplary embodiment will be described taking a charging device that is employed in an electrophotographic image forming apparatus as an example. The charging device according to the present disclosure is also applicable to a type of charging device such as the above-mentioned charging device disclosed in Japanese Unexamined Patent Application Publication No. 2009-132507 other than a charging device that is employed in an image forming apparatus.

Figure 1:
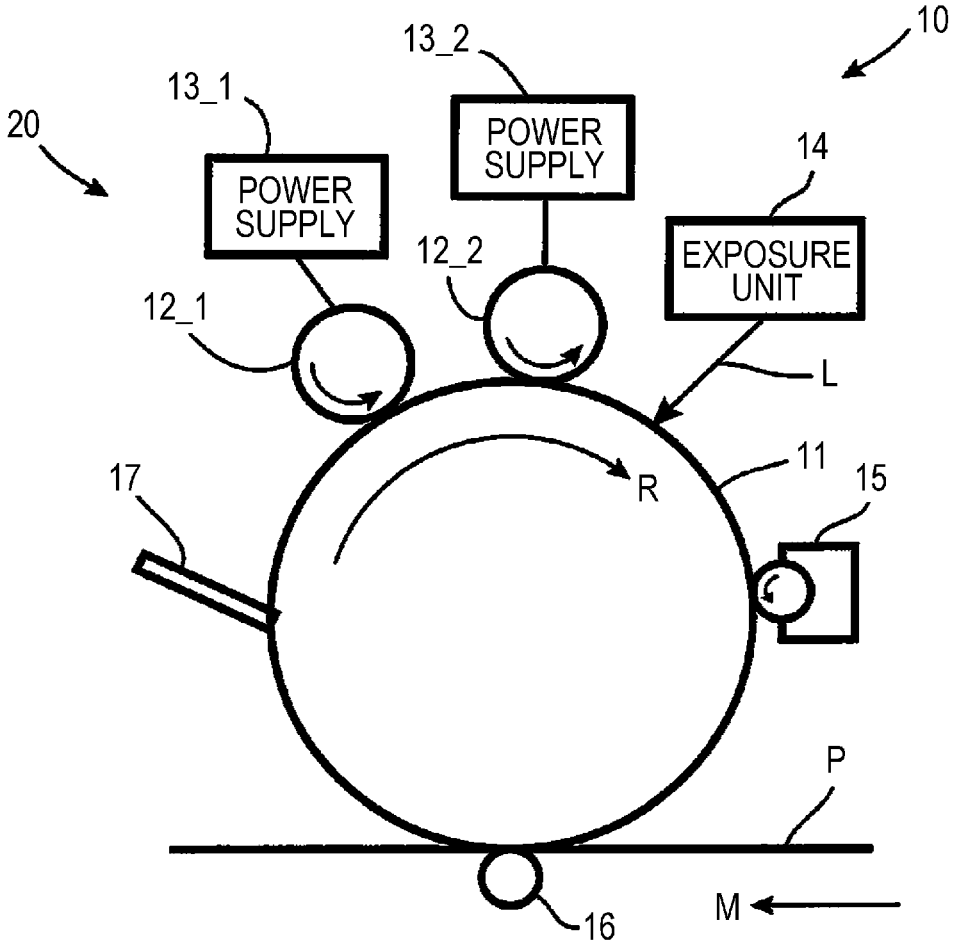
FIG. 1 is a schematic diagram illustrating a toner-image forming unit, which is a principal portion of an image forming apparatus.

FIG. 1 is a schematic diagram illustrating a toner-image forming unit, which is a principal portion of an image forming apparatus.

A toner-image forming unit 10 includes an image carrier 11. An electrostatic latent image is formed onto a surface of the image carrier 11 through processes of charging and light exposure while the image carrier 11 rotates in the direction of arrow R. Then, the electrostatic latent image is developed into a toner image with a toner, and the toner image is temporarily held on the image carrier 11.

The toner-image forming unit 10 further includes a charging device 20. The charging device 20 includes two charging rollers 12_1 and 12_2. The charging roller 12_1 that is one of the two charging rollers and that is disposed on an upstream side in the direction of rotation of the image carrier 11 corresponds to an example of a first charging unit according to the present disclosure and an example of a first charging roller according to the present disclosure. The charging roller 12_2 that is disposed on a downstream side corresponds to an example of a second charging unit according to the present disclosure and an example of a second charging roller according to the present disclosure.

The charging device 20 further includes power supplies 13_1 and 13_2 that respectively apply a charge voltage to the two charging rollers 12_1 and 12_2. As a result of the charge voltage being applied to the two charging rollers 12_1 and 12_2 by the power supplies 13_1 and 13_2, respectively, the charging rollers 12_1 and 12_2 charge the image carrier 11 to a uniform electric potential. The theme of the present exemplary embodiment is to suppress non-uniformity in the charge voltage in a direction in which a rotation axis of the image carrier 11 extends (hereinafter referred to as rotation axis direction). Details of this matter will be described later.

The toner-image forming unit 10 further includes an exposure unit 14 and a developing unit 15. The exposure unit 14 radiates exposure light L that is modulated on the basis of an image signal onto the image carrier 11 so as to form an electrostatic latent image onto the surface of the image carrier 11. The developing unit 15 contains a developer including a toner and a carrier and develops an electrostatic latent image on the image carrier 11 with the toner in the developer so as to form a toner image onto the image carrier 11. The toner image is transferred onto a sheet P that is transported in the direction of arrow M by operation of a transfer roller 16. Residual toner that remains on the image carrier 11 after the toner image has been transferred by the transfer roller 16 is scraped off by a cleaning blade 17.

The toner image transferred to the sheet P is fixed onto the sheet P by a fixing device (not illustrated), so that an image, which is formed of the fixed toner image, is formed onto the sheet P.

Figure 2A:
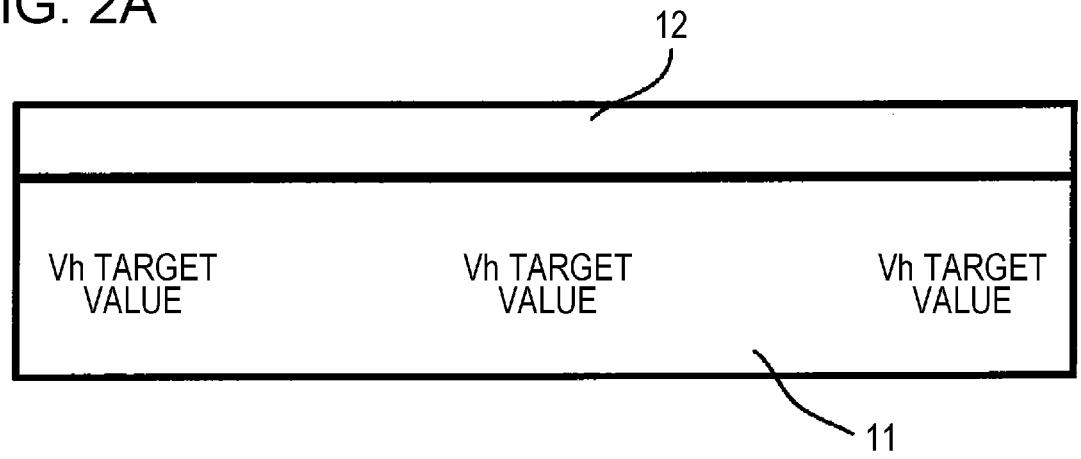
FIGS. 2A and 2B are diagrams illustrating a problem that may occur over time due to charging.
Figure 2B:
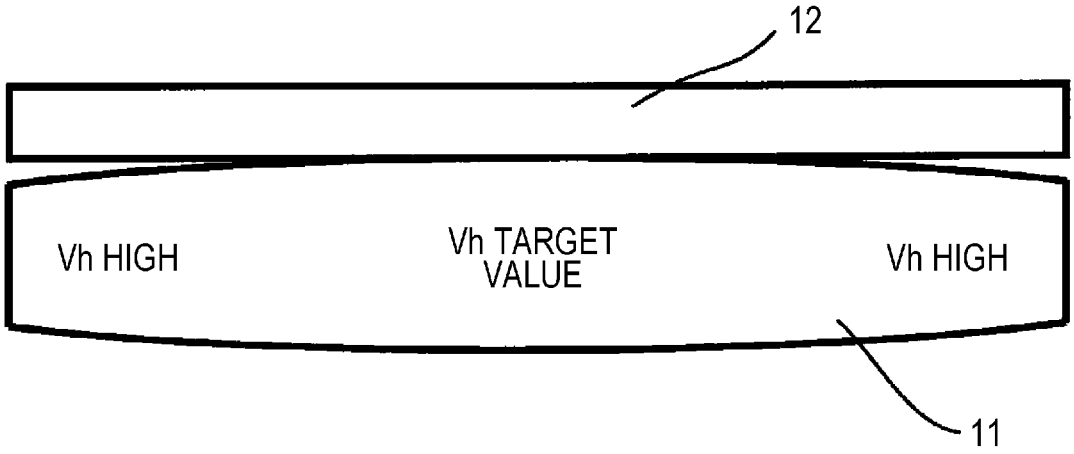

FIGS. 2A and 2B are diagrams illustrating a problem that may occur over time due to charging. FIG. 2A is a schematic diagram illustrating the image carrier 11 and a developing roller 12 each of which is in an initial state, and FIG. 2B is a schematic diagram illustrating the image carrier 11 and the developing roller 12 after elapse of time (e.g., after forming images onto 60,000 sheets). As illustrated in FIG. 1, although an image forming unit 1 includes the two charging rollers 12_1 and 12_2, the two charging rollers are illustrated as the single charging roller 12 in FIGS. 2A and 2B instead of being illustrated separately. The transverse direction in FIGS. 2A and 2B is parallel to the rotation axis direction of the image carrier 11, that is, a direction perpendicular to the plane in FIG. 1.

In the initial state illustrated in FIG. 2A, a central portion and end portions of the image carrier 11 in the rotation axis direction are all uniformly charged to a charge voltage Vh, which is a target value.

The image carrier 11 is started to be used from the above initial state. A photosensitive layer (not illustrated) that is formed on the surface of the image carrier 11 is gradually worn down by the sheet P, which is transported, and becomes thin, and the end portions of the photosensitive layer wear down more than a central portion of the photosensitive layer does. In this case, if the central portion of the photosensitive layer is charged to the charge voltage Vh that is the target value by taking into consideration its state after elapse of time, the end portions of the photosensitive layer are charged to the charge voltage Vh that is higher than the target value because the end portions are thinner. As a result, the carrier contained in the developer in the developing unit 15, which is illustrated in FIG. 1, is likely to transfer to the image carrier 11, and a phenomenon in which the carrier actually adheres to the image carrier 11 may sometimes occur. In this case, the carrier scratches a toner image in the rotation direction indicated by arrow R, and an image defect in the form of a streak may sometimes occur. In the present exemplary embodiment, a unit that suppresses occurrence of the above image defect is provided.

Figure 3A:
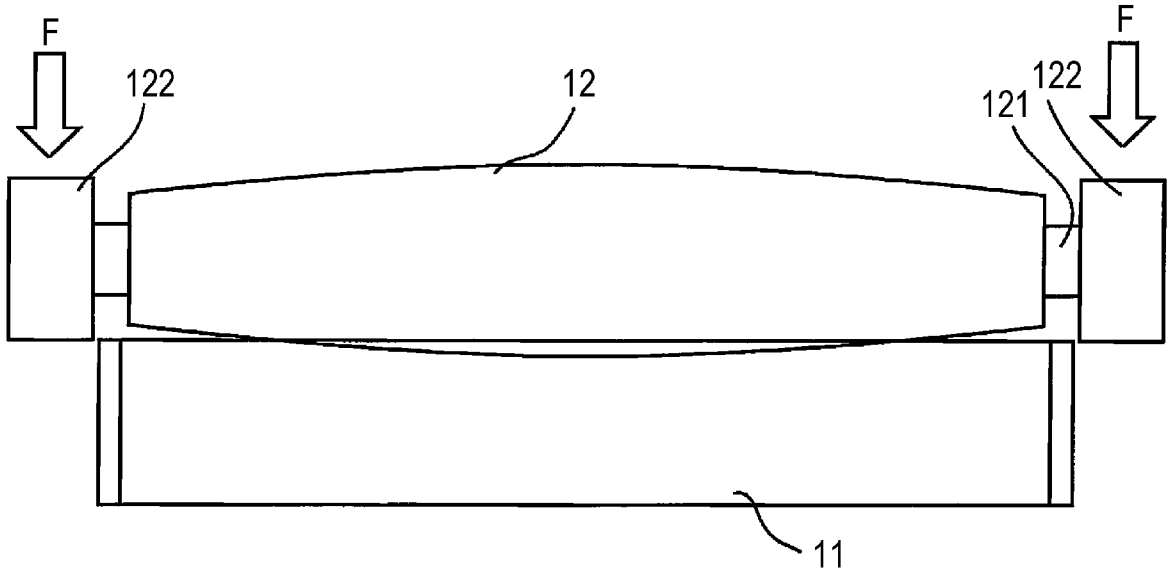
FIGS. 3A to 3C are respectively a schematic diagram illustrating a state where a charging roller is pressed against an image carrier, a schematic diagram illustrating a shape of a nip region, and a schematic diagram illustrating another shape of the nip region.
Figure 3B:
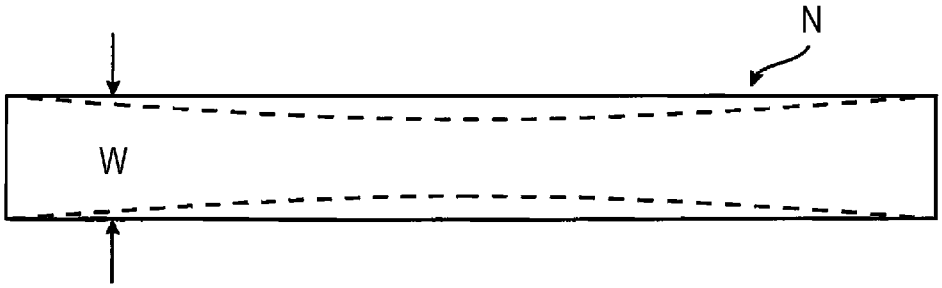
Figure 3C:
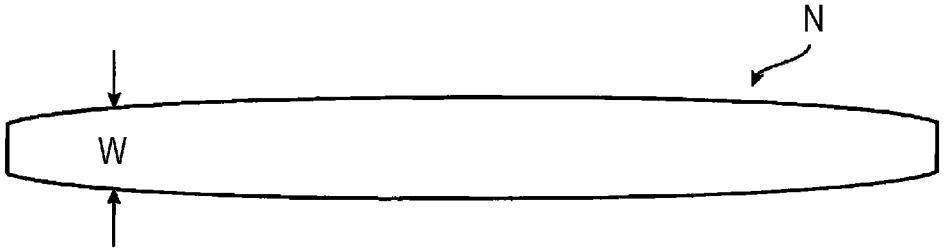

FIGS. 3A to 3C are respectively a schematic diagram illustrating the state where the charging roller is pressed against the image carrier, a schematic diagram illustrating a shape of a nip region, and a schematic diagram illustrating another shape of the nip region.

As illustrated in FIG. 3A, the charging roller 12 is formed of a rubber-like elastic body and includes a rotary shaft 121 extending through the center of the elastic body and bearings 122 disposed on either side of the elastic body. Each of the bearings 122 is pressed against the image carrier 11 by a pressing force F applied a spring member or the like (not illustrated). FIG. 3A illustrates the crowned charging roller 12 that has a relatively large diameter at the center thereof and a relatively small diameter at the two ends thereof in a direction in which the rotary shaft 121 extends (hereinafter referred to as rotary shaft direction). Accordingly, although FIG. 3A illustrates the charging roller 12 as if the central portion of the charging roller 12 digs into the image carrier 11, in practice, the central portion is pressed against the image carrier 11 so as to deform, and a nip region N is defined by the image carrier 11 and the charging roller 12 that are in contact with each other. The nip region N corresponds to a contact region according to the present disclosure.

In FIG. 3B, the nip region N having a rectangular shape is indicated by a solid line, and another nip region N is indicated by a dashed line. In the rectangular nip region N, a nip width W at the center and a nip width W at each of the two ends are the same as each other. In the other nip region N, the nip width W at the center is smaller than the nip width W at each of the two ends. As illustrated in FIG. 3A, the bearings 122 of the charging roller 12, which are disposed on either side of the charging roller 12, are pressed. Thus, even in the case of the charging roller 12 that has a crowned shape when it is not in contact with the image carrier 11, the rotary shaft 121 is slightly deformed as a result of the charging roller 12 being pressed, so that the rectangular nip region N, in which the nip width W at the center and the nip width W at each of the two ends are the same as each other, or the other nip region N, in which the nip width W at the center is smaller than the nip width W at each of the two ends, may be formed. The nip width W affects charging performance. In the case where the photosensitive layer of the image carrier 11 has a uniform thickness, by setting the nip width W at the center and the nip width W at each of the two ends to be the same as each other, the central portion and the end portions of the image carrier 11 may be charged with the uniform charge voltage Vh. Alternatively, by setting the nip width W at the center to be smaller than the nip width W at each of the two ends, charging may be performed in such a manner that the end portions of the image carrier 11 are charged to the charge voltage Vh higher than that to which the central portion of the image carrier 11 is charged. The nip regions N illustrated in FIG. 3B are typical examples of the nip region N of the upstream charging roller 12_1, which is one of the two charging rollers 12_1 and 12_2 illustrated in FIG. 1.

FIG. 3C illustrates another nip region N in which the nip width W at the center is relatively larger than the nip width W at each of the ends. In the case where the nip width W at the center is large as illustrated in FIG. 3C, the central portion of the image carrier 11 is charged to the higher charge voltage Vh, and the end portions of the image carrier 11 are charged to the relatively lower charge voltage Vh. The nip region N illustrated in FIG. 3C is a typical example of the nip region N of the downstream charging roller 12_2, which is one of the two charging rollers 12_1 and 12_2 illustrated in FIG. 1.

Adjustment of the nip region N into the shapes such as those illustrated in FIGS. 3B and 3C is performed by adjusting the following parameters.

Here, assume that the diameter of the charging roller 12 when the charging roller 12 is not in contact with the image carrier 11 has a symmetrical distribution in the rotary shaft direction, and the two end portions of the charging roller 12 are pressed against the image carrier 11 by the same pressing force F, so that the nip width W, which is the width of the nip region N in a process direction, also has a symmetrical distribution in the rotary shaft direction.

With the above assumption, the shape of the nip region N may be adjusted by, for example, performing one of the following:

varying the distribution of the diameter of the charging roller 12 in the rotary shaft direction, specifically, adjusting the difference in diameter between the central portion and the end portions of the charging roller 12 and adjusting the pressing force F.

In particular, in order to form the nip region N having the shape illustrated in FIG. 3C, it is effective to employ the crowned charging roller 12 and press the crowned charging roller 12 by the pressing force F that is smaller than the pressing force F applied to the charging roller 12 that forms the nip regions N having the shapes illustrated in FIG. 3B.

Note that, in the case of forming the nip region N that is indicated by a dashed line in FIG. 3B and in which the nip width W at the center is small, the charging roller 12 does not need to have a crowned shape. However, the nip region N is also formable with the crowned charging roller 12.

Here, the charging roller that forms the nip regions illustrated in FIG. 3B will be referred to as a main charging roller since it is configured to mainly charge the image carrier 11. The charging roller that forms the nip region illustrated in FIG. 3C will be referred to as an auxiliary charging roller since it is configured to adjust the distribution of the charge voltage Vh in the rotation axis direction.

The image carrier 11 is charged to the charge voltage Vh that is uniform in the rotation axis direction by the main charging roller or is charged by the main charging roller in such a manner that the end portions of the image carrier 11 are charged slightly stronger than the central portion of the image carrier 11 is. The image carrier 11 is charged by the auxiliary charging roller in such a manner that the central portion of the image carrier 11 in the rotation axis is strongly charged. In the initial state, the voltage that is applied to the auxiliary charging roller is adjusted so as to control the charging of the central portion of the image carrier 11 such that the central portion and the end portions of the image carrier 11 have the same charge potential within an acceptable range.

As time progresses, the charge potential at each of the end portions increases as described with reference to FIG. 2B. Accordingly, the voltage applied to the auxiliary charging roller is increased. In addition, the fact that the thickness of the photosensitive layer of the image carrier 11 is reduced over time and that the charge voltage rises is also utilized. The auxiliary charging roller forms the nip region N having the shape illustrated in FIG. 3C and strongly charges the central portion of the image carrier 11. Then, the charge voltage in the central portion also rises, and as in the initial state, the central portion and the end portions have the same charge potential within the acceptable range. The overall charge voltage Vh may be adjusted to the target charge voltage by adjusting the voltage applied to the main charging roller.

The charging device 20 according to the present exemplary embodiment includes the two charging rollers 12_1 and 12_2, and these two charging rollers 12_1 and 12_2 are assigned different roles as described above while configured to perform strong charging.

Note that the two charging rollers 12_1 and 12_2 illustrated in FIG. 1 may change their roles, that is, the upstream charging roller 12_1 may serve as the auxiliary charging roller, and the downstream charging roller 12_2 may serve as the main charging roller.

FIGS. 4A and 4B are diagrams illustrating parameters of the main and auxiliary charging rollers that are manufactured on the basis of the above concept and results after elapse of time. The first example will be mainly described below.

FIG. 4A illustrates "nip load (N)", "crown amount (μm)", "A nip width (mm)", and "initial Δ potential (V)" as the parameters of the main and auxiliary charging rollers.

The parameter "nip load (N)" is the sum of the pressing force F on the left-hand side and the pressing force F on the right-hand side in FIG. 3A. In the first example, the nip load of the main charging roller is 5 newtons (N), and the nip load of the auxiliary charging roller is 2 N. The main charging roller is pressed against the image carrier 11 with a force larger than the pressing force applied to the auxiliary charging roller. As a result, the image carrier 11 forms the nip regions N having the shapes illustrated in FIG. 3B, and the auxiliary charging roller forms the nip region N having the shape illustrated in FIG. 3C.

The parameter "crown amount (μm)" indicates how large the diameter of the central portion is with respect to the diameter of each of the end portions. In the first example, the crown amount of the main charging roller is 90 μm. This indicates that the diameter of the central portion of the main charging roller is larger than the diameter of each of the end portions of the main charging roller by 90 μm. In contrast, the crown amount of the auxiliary charging roller in the first example is 140 μm. In other words, in the first example, the crown amount of the auxiliary charging roller is larger than that of the main charging roller. Together with the difference in "nip load (N)", this parameter setting helps the main charging roller and the auxiliary charging roller to form the nip regions N having the shapes illustrated in FIG. 3B and the nip region N having the shape illustrated in FIG. 3C, respectively.

The parameter "Δ nip width (mm)" relates to the nip widths W illustrated in each of FIGS. 3B and 3C and indicates how much wider the nip width of each of the end portions is than the nip width of the central portion. In the first example, the Δ nip width of the main charging roller is 0.2 mm. This indicates that the nip width of each of the end portions of the main charging roller is wider than the nip width of the central portion of the main charging roller by 0.2 mm. In other words, it indicates that the nip region N of the main charging roller has a shape such as that indicated by a dashed line in FIG. 3B. In contrast, the Δ nip width of the auxiliary charging roller in the first example is −0.3 mm. This indicates that the nip width of each of the end portions of the auxiliary charging roller is narrower than the nip width of the central portion of the auxiliary charging roller by 0.3 mm. In other words, it indicates that the nip region N of the auxiliary charging roller has a shape such as that illustrated in FIG. 3C.

The parameter "initial Δ potential (V)" indicates a difference value (V) between the charge potential of the central portion and the charge potential of each of the end portions in the initial state. Here, a target charge potential is set to 500 V. The acceptable range of the difference value is set to ±20 V.

FIG. 4A illustrates difference values only relating to the main charging roller and difference values only relating to the auxiliary charging roller. Each of these values is calculated on the basis of the nip width W, the voltage applied to the corresponding roller, and so forth. In the first example, the "initial Δ potential (V)" of the main charging roller is 5 V. This indicates that the main charging roller charges the image carrier 11 in such a manner that the end portions of the image carrier 11 are charged to the charge voltage Vh higher by 5 V than that to which the central portion of the image carrier 11 is charged. In contrast, the "initial Δ potential (V)" of the auxiliary charging roller in the first example is −10 V. This indicates that the auxiliary charging roller charges the image carrier 11 in such a manner that the central portion of the image carrier 11 is charged to the charge voltage Vh higher by 10 V than that to which the end portions of the image carrier 11 are each charged. Therefore, according to the calculation, the image carrier 11 is charged by the two main and auxiliary charging rollers in such a manner that the central portion of the image carrier 11 is charged to the charge voltage Vh higher by 5 V than that to which the end portions of the image carrier 11 are each charged. Since the difference value between the charge potential of the central portion and the charge potential of each of the end portions is allowed up to ±20 V, the difference value 5 V is within the acceptable range.

A uniform image with an area coverage of 5% is formed onto an A4 normal sheet by using the main and auxiliary charging rollers having the above-mentioned parameters in the initial state. In this case, a charge potential difference of 10 V occurs in the image carrier 11 each time the image carrier 11 is worn down by 1 μm. Thus, the amount of wear is estimated from the number of sheets on which images are formed, and the voltage applied to the auxiliary charging roller is increased in accordance with the number of sheets on which images are formed.

Then, the number of sheets on which images are formed until an image defect in the form of a streak extending in the process direction appears on one of the images or until the carrier is detected on one of the images is determined. Here, the aim is to prevent an abnormality from occurring before images are formed onto 60,000 sheets. In FIG. 4B, the letter "A" in the "reliability evaluation result" column indicates that images are formed on 70,000 sheets with no problem. The letter "B" indicates that a problem occurs when the number of sheets on which images are formed exceeds 60,000. The letter "C" indicates that a problem occurs when the number of sheets on which images are formed is less than 60,000.

The "result" column in FIG. 4B indicates data after elapse of time. More specifically, the "result" column includes the "amount of uneven wear after elapse of time (μm)" column, the "Δ potential after elapse of time (V)" (calculated value only relating to main charging roller) column, and the "Δ potential after elapse of time (V)" (sum of main charging roller and auxiliary charging roller) column. Each value in the "result" column is a value when the number of sheets on which images are formed is 70,000 (in the case of "A") or when a problem occurs (in the case of "B" or "C").

In the first example, the "amount of uneven wear after elapse of time (μm)" is 2 μm. This indicates that the wear amount of each of the end portions of the image carrier 11 is larger by 2 μm than that of the central portion of the image carrier 11.

In the first example, the "Δ potential after elapse of time (V)" (calculated value only relating to main charging roller) is 25 V. This indicates that, in the case of the main charging roller alone, the end portions of the image carrier 11 are charged to the charge voltage higher by 25 V than that to which the central portion of the image carrier 11 is charged.

In the first example, the "Δ potential after elapse of time (V)" (sum of main charging roller and auxiliary charging roller) is 15 V. This indicates that the end portions of the image carrier 11 are charged to the charge voltage higher by 15 V than that to which the central portion of the image carrier 11 is charged. In other words, the difference between the charge potential of each of the end portions and the charge potential of the central portion is smaller than that in the case of the main charging roller alone and is within ±20 V, which is the target range. The "reliability evaluation result" of the first example is "A".

Referring to the "Δ potential after elapse of time (V)" (sum of main charging roller and auxiliary charging roller) column from the top, the values of the first example, the second example, and the third example are all within ±20 V, which is the target range. In addition, the "reliability evaluation result" of the first example and the "reliability evaluation result" of the second example are both "A". The value of the third example is 20 V and is within the acceptable range somehow, and the "reliability evaluation result" of the third example is "B". Although the first to third examples are accepted, the value of the first comparative example is 35 V, and the "reliability evaluation result" of the third example is "C". It is understood from the parameters of the main and auxiliary charging rollers of the first comparative example that charging rollers that are the same as each other are used as the main charging roller and the auxiliary charging roller.

Note that, in each of the first to third examples, although the main charging roller is disposed at the position of the upstream charging roller 12_1, which is one of the two charging rollers 12_1 and 12_2 illustrated in FIG. 1, and the auxiliary charging roller is disposed at the position of the downstream charging roller 12_2, the main charging roller may be disposed on the downstream side, and the auxiliary charging roller may be disposed on the upstream side.

As described above, the charging device according to the present exemplary embodiment includes the two charging rollers, and these charging rollers are assigned different roles while configured to perform strong charging in such a manner as to compensate for the shortcomings of each other.

Note that, although a charging device that is incorporated into an electrophotographic image forming apparatus has been described above as an example, the charging device according to the present disclosure may be employed as a charging device, such as that disclosed in Japanese Unexamined Patent Application Publication No. 2009-132507, that is configured to prevent a sheet from moving in a serpentine manner or to prevent weaving of a sheet and charging devices for various other applications.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A charging device comprising:

a first charging unit that charges a target unit, which is to be charged, by coming into contact with the target unit; and a second charging unit that charges the target unit by coming into contact with the target unit and in which distribution of a contact region in contact with the target unit is different from distribution of a contact region between the target unit and the first charging unit, wherein the first charging unit and the second charging unit are respectively a first charging roller and a second charging roller each of which rotates while being in contact with the target unit as a result of end portions of each of the first and second charging rollers in a direction in which rotation axes of the first and second charging rollers extend being pressed against the target unit, and wherein a pressing force applied to the first charging roller and a pressing force applied to the second charging roller are different from each other.

2. The charging device according to claim 1, wherein a diameter of the first charging roller when the first charging roller is not in contact with the target unit and a diameter of the second charging roller when the second charging roller is not in contact with the target unit both have a symmetrical distribution in a direction in which rotation axes of the first and second charging rollers extend, and the distribution of the diameter of the first charging roller and the distribution of the diameter of the second charging roller are different from each other.

3. The charging device according to claim 2, wherein at least one of the first charging roller and the second charging roller is a crowned charging roller that has a relatively large diameter at the center and a relatively small diameter at two ends in a direction in which a rotation axis of the crowned charging roller extends.

4. The charging device according to claim 3, wherein one of the first charging roller and the second charging roller that receives a relatively small pressing force is a crowned charging roller that has a relatively large diameter at the center and a relatively small diameter at two ends in a direction in which a rotation axis of the crowned charging roller extends.

5. The charging device according to claim 4, further comprising:

a power supply that increases a voltage applied to the crowned charging roller over time.

6. The charging device according to claim 2, wherein one of the first charging roller and the second charging roller that receives a relatively small pressing force is a crowned charging roller that has a relatively large diameter at the center and a relatively small diameter at two ends in a direction in which a rotation axis of the crowned charging roller extends.

7. The charging device according to claim 6, further comprising:

a power supply that increases a voltage applied to the crowned charging roller over time.

8. The charging device according to claim 1, wherein one of the first charging roller and the second charging roller that receives a relatively small pressing force is a crowned charging roller that has a relatively large diameter at the center and a relatively small diameter at two ends in a direction in which a rotation axis of the crowned charging roller extends.

9. The charging device according to claim 8, further comprising:

a power supply that increases a voltage applied to the crowned charging roller over time.

10. An image forming apparatus comprising:

the charging device according to claim 1; and an image holding unit that serves as a unit to be charged by the charging device and that is charged by the charging device, the image holding unit being configured to hold an electrostatic latent image formed through light exposure and to hold a toner image formed through development with a toner, wherein the image forming apparatus forms, onto a sheet, an image derived from the toner image formed on the image holding unit.

11. A charging device comprising:

first charging means for charging a target unit, which is to be charged, by coming into contact with the target unit; and second charging means for charging the target unit by coming into contact with the target unit and in which distribution of a contact region in contact with the target unit is different from distribution of a contact region between the target unit and the first charging means, wherein the first charging means and the second charging means are respectively pressed against the target unit, and wherein a pressing force applied to the first charging means and a pressing force applied to the second charging means are different from each other.

12. The charging device according to claim 11 further comprising:

a power supply that increases a voltage applied to at least one of the first charging means and the second charging means over time.

* * * * *